US007795769B2

(12) United States Patent
Cartwright et al.

(10) Patent No.: US 7,795,769 B2
(45) Date of Patent: Sep. 14, 2010

(54) COVER FOR THE MOTOR HOUSING OF A CEILING FAN

(76) Inventors: Thomas Cartwright, 365 NE. Baker Rd., Stuart, FL (US) 34994; Allison Cartwright, 365 NE. Baker Rd., Stuart, FL (US) 34994

( * ) Notice: Subject to any disclaimer, the term of this patent is extended or adjusted under 35 U.S.C. 154(b) by 290 days.

(21) Appl. No.: 11/871,557

(22) Filed: Oct. 12, 2007

(65) Prior Publication Data

US 2008/0089791 A1 Apr. 17, 2008

Related U.S. Application Data

(60) Provisional application No. 60/851,418, filed on Oct. 13, 2006, provisional application No. 60/851,401, filed on Oct. 13, 2006.

(51) Int. Cl.
*H02K 5/00* (2006.01)
*F03D 11/00* (2006.01)

(52) U.S. Cl. ..... 310/89; 150/165; 416/5; 160/DIG. 16

(58) Field of Classification Search ..... 310/85, 310/89; 40/661.01, 600, 124.04; 206/818; 150/154, 165; D23/411; 416/43 R, 93 R, 416/5; 160/DIG. 6
See application file for complete search history.

(56) References Cited

U.S. PATENT DOCUMENTS

| | | | | | |
|---|---|---|---|---|---|
| 3,289,338 | A * | 12/1966 | Stephens | 40/603 |
| 3,698,111 | A * | 10/1972 | Smith | 40/661.01 |
| 4,518,314 | A * | 5/1985 | Schultz | 416/93 R |
| 4,863,346 | A * | 9/1989 | Lin | 416/5 |
| 5,158,486 | A * | 10/1992 | Tamame | 62/506 |
| 5,503,524 | A * | 4/1996 | Yu | 416/5 |
| 5,511,822 | A * | 4/1996 | Wolanski | 280/770 |
| 5,681,147 | A * | 10/1997 | Yung-Chung | 416/244 R |
| 5,829,622 | A * | 11/1998 | Neuman | 220/230 |
| D408,520 | S * | 4/1999 | Zuege | D23/411 |
| 5,899,663 | A * | 5/1999 | Feder et al. | 416/5 |
| 6,250,005 | B1 * | 6/2001 | Richards | 40/665 |
| D446,299 | S * | 8/2001 | Chiang | D23/411 |
| D485,348 | S * | 1/2004 | Stauffer | D23/411 |
| 7,078,085 | B2 * | 7/2006 | Nykamp et al. | 428/99 |
| 2005/0229449 | A1 * | 10/2005 | Shepley | 40/306 |

* cited by examiner

*Primary Examiner*—Burton Mullins
(74) *Attorney, Agent, or Firm*—Thomas R. FitzGerald, Esq.; Hiscock & Barclay, LLP

(57) ABSTRACT

A cover for the motor housing of a ceiling fan includes a flexible wrap for covering the motor housing and a magnetic assemblage for attaching the wrap to the motor housing. The cover can be insulating, have an outer decorative surface for aesthetic effects, or both. A ship lap joint may be included to secure the ends of the cover together.

17 Claims, 3 Drawing Sheets

COVER FOR THE MOTOR HOUSING OF A CEILING FAN

CROSS-REFERENCE TO RELATED APPLICATIONS

This application claims the benefit of priority from U.S. Provisional Patent Application Ser. No. 60/851,418, filed Oct. 13, 2006 and U.S. Provisional Patent Application Ser. No. 60/851,401, filed Oct. 13, 2006. The disclosures of both prior patent applications are herein incorporated by reference.

FIELD OF THE INVENTION

This invention relates in general to ceiling fans and more particularly to a cover for the motor housing of a ceiling fan.

BACKGROUND OF THE INVENTION

Ceiling fans are popular commercial and consumer items. They move air in a room to more evenly distribute the air and keep the room at a more constant temperature. Ceiling fans are often used to cool people by providing a stream of air over their bodies. The air stream enhances body cooling by evaporating any surface body moisture by removing heat from the surface of the skin.

Ceiling fans generally include a plurality of fan blades attached to and arrayed circumferentially around a blade hub. The blade hub is mounted to a motor contained in a motor housing that is supported by a down rod affixed to a ceiling. The motor and motor housing are generally cylindrical in shape and the motor housing is generally of a ferrous material such as iron, steel, or the like. Ceiling fans are commercially available in many shapes and configurations. Often, the motor housing is only painted. In many applications, it may be desirable to insulate the motor housing, decorate it to achieve an aesthetic effect, or both.

There is thus a need for a decorative and/or insulative cover that can be attached around the motor housing in a simple, efficient, and economical manner.

SUMMARY OF THE INVENTION

According to the present invention there is provided a solution to these needs.

According to a feature of the present invention there is provided a cover for the motor housing of a ceiling fan including a flexible wrap for covering a ceiling fan motor housing and a magnetic assemblage associated with said flexible wrap for attaching the wrap to the motor housing.

Particularly the invention comprises a cover for a motor housing of a ceiling fan. The cover includes a flexible wrap for covering a ceiling fan motor housing; and a magnetic assemblage associated with the flexible wrap for attaching the wrap to the motor housing. The magnetic assemblage may include at least one magnet assembled with said flexible wrap. Further, the magnetic assemblage includes a plurality of magnets and the wrap has a plurality of pockets for holding the magnets. Alternatively, the magnetic assemblage includes magnetic particles distributed about a region of the wrap. The magnets may be located proximate to the ends of the wrap, distributed along the length of the wrap, or both. The cover may include auxiliary means for holding two ends of the cover together, such as ship lap ends defined by the ends of the cover and means for connecting one ship lap end to the other. The auxiliary means alternatively comprises a convex ridge at one end and a receiver channel at the other end, the convex ridge and the receiver channel being sized relative to each other to secure the ends together. A pair of bias ridges may be disposed on the edges of the receiver channel in order to retain the convex ridge in the receiving channel.

An advantage of the present invention is that the ceiling fan motor housing cover can provide decorative effects, insulative effects, or both to the motor housing. A further advantage of the present invention is that the ceiling fan motor housing cover is simple, efficient, economical, and can be easily attached to the motor housing.

BRIEF DESCRIPTION OF THE DRAWINGS

Corresponding reference characters indicate corresponding parts throughout the several views. The examples set out herein illustrate several embodiments of the invention but should not be construed as limiting the scope of the invention in any manner.

DETAILED DESCRIPTION OF THE INVENTION

Figure 1:
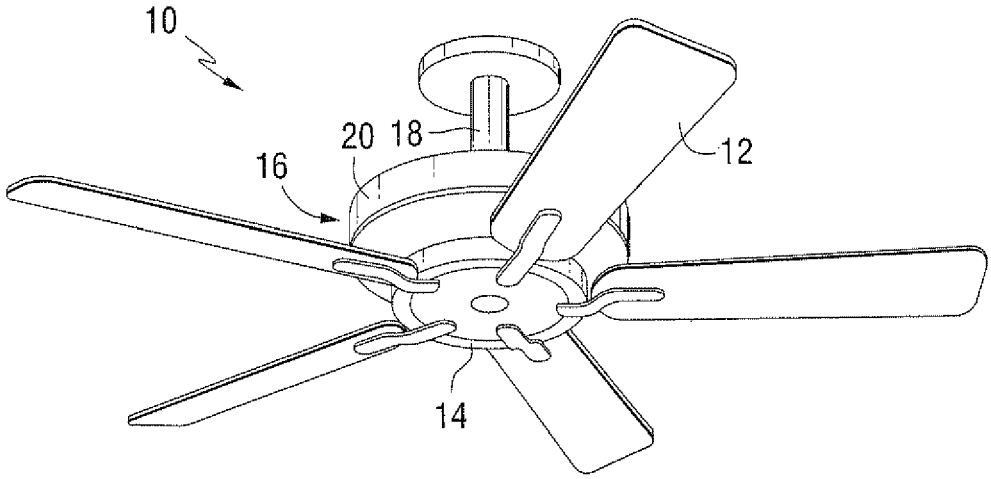
FIG. 1 is a perspective view of a ceiling fan incorporating the present invention

Referring now to FIG. 1, there is shown a ceiling fan incorporating an embodiment of the present invention. As shown, ceiling fan 10 includes a plurality of fan blades 12 circumferentially arrayed about and attached to a blade hub 14. The blade hub 14 is mounted to a motor contained in a motor housing 16 supported by down rod 18. Motor housing 16 is of a ferrous material such as iron or steel. According to the present invention, cover 20 is attached to motor housing 16 by means of a magnetic assemblage.

Figure 2:
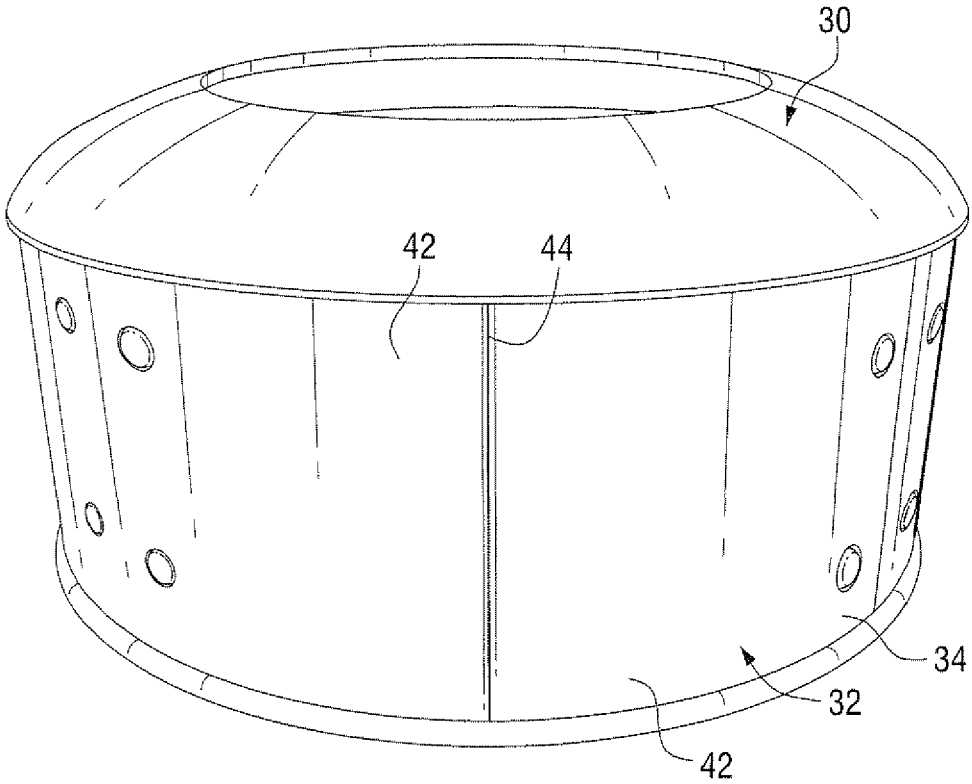
FIGS. 2-5 are diagrammatic views showing an embodiment of the present invention.
Figure 3:
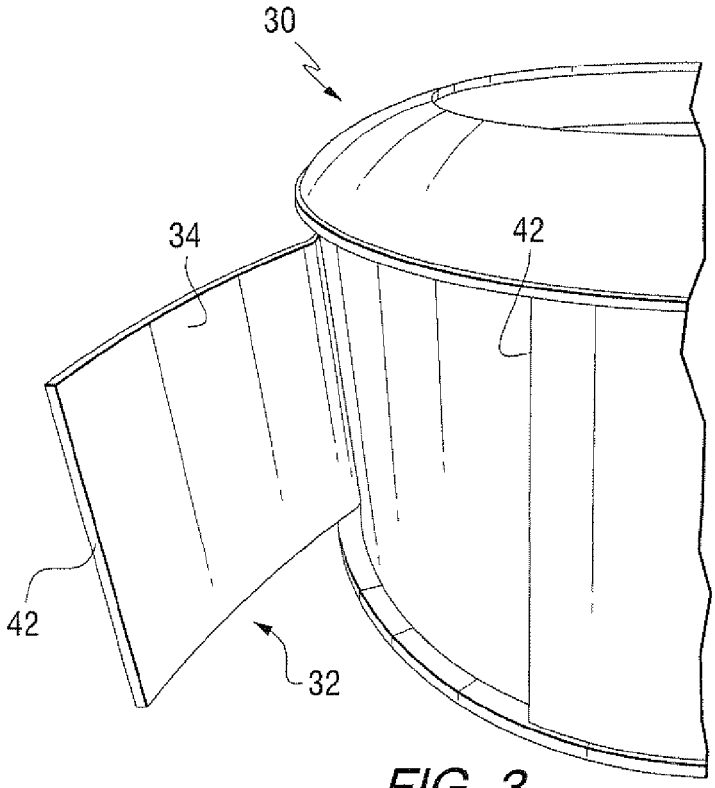

FIGS. 2-5 show an embodiment of the present invention. As shown in FIG. 2, motor housing 30 is of cylindrical shape and has a flexible cover 32 attached to it. Cover 32 includes a flexible wrap 34 of plastic, fabric, or the like, having a magnetic assemblage 36 for attaching wrap 34 to motor housing 30. In certain embodiments, the wrap 34 comprises layers of material, such as a layer of flexible plastic and a layer of fabric, or two layers of plastic. The layers may include an insulation material, or an outer layer of decorative material for aesthetic effects.

Figure 4:
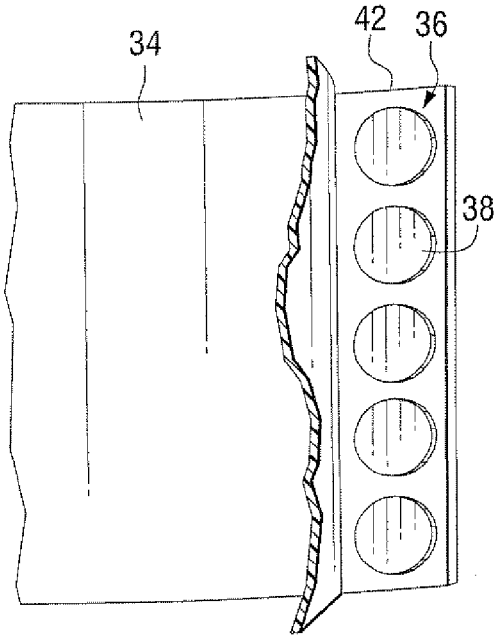
Figure 5:
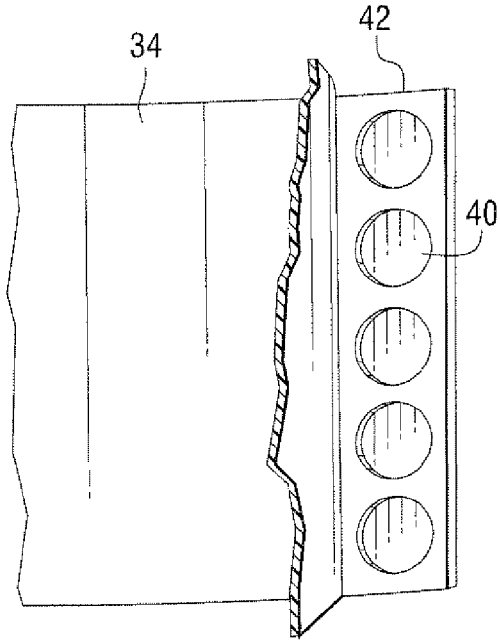

Magnetic assemblage 36 is shown in FIG. 4 as including a plurality of magnets 38 located in pockets 40 (FIG. 5) proximate to the ends 42 of the wrap 34. Other arrays of magnets either greater or fewer in number, and in other configurations are also possible. Further, the magnets may be distributed along the length of the wrap 34 instead of at just the ends 42. In addition, the wrap 34 can have a layer of material with magnetic particles distributed throughout at least a region of the material for magnetic attachment. If the motor housing is not magnetic, magnetic regions can be affixed to the motor housing to which the cover of the invention is magnetically attached.

In operation, the wrap 34 is wrapped around the motor housing 16 with the ends 42 coming together at a seam 44. The magnets 38 secure the wrap 34 to the motor housing 16.

While the above embodiment of the invention performs its intended function, it is possible that vibration of the motor housing may urge the ends 42 away form each other and expose portions of the motor housing. In order to overcome that possibility the invention provides a ship lapped connection on the ends of the cover. The ship lapped connection will hold the ends of the cover together to prevent the magnets from sliding apart while under the influence of vibration or other separating forces.

Figure 6:
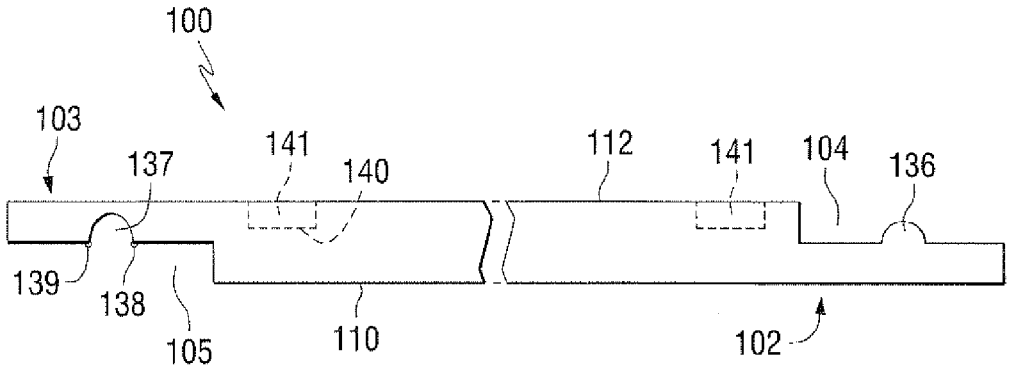
FIG. 6 is a partial edge view of another embodiment of the cover.
Figure 7:
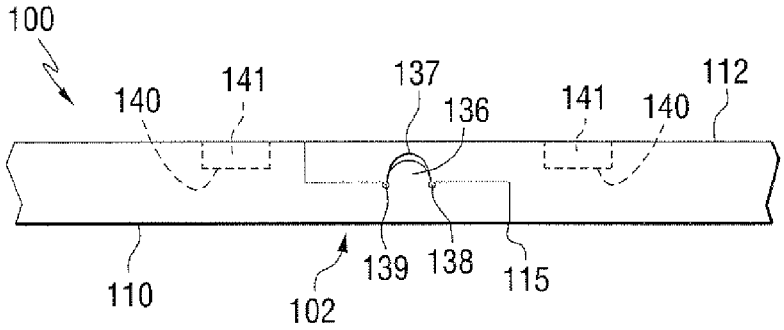
FIG. 7 is a partial edge view of the assembled cover of FIG. 6.
Figure 8:
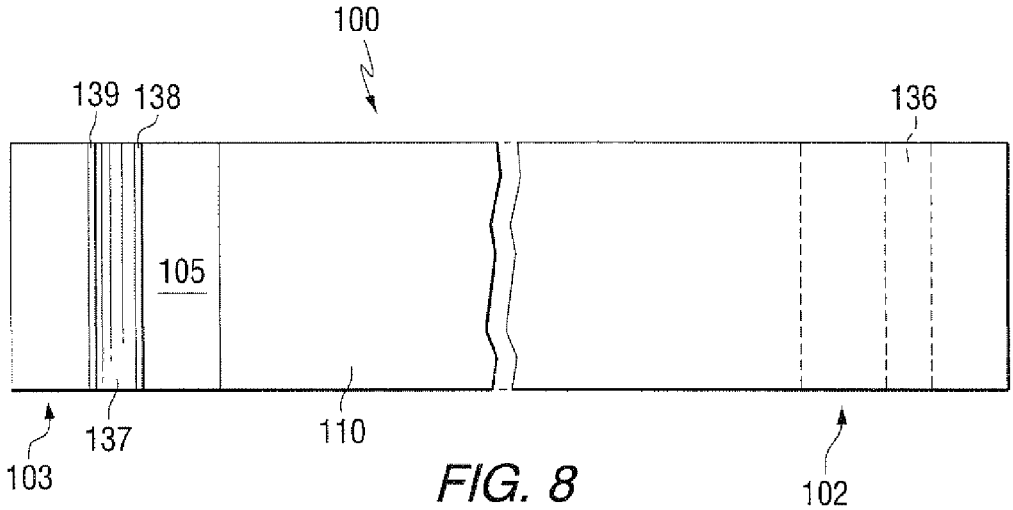
FIG. 8 is a partial plan view of the cover of FIG. 6.

A second embodiment is shown in FIGS. 6-8. The cover 100 has a front surface 110 that faces away from the motor housing and a rear surface 112 that faces toward the motor housing. At end 102 the ship lap joint is a recess 104 that extends about half the thickness of the body 100. On the opposite end 103 there is a mating recess 105. Ship lap end 102 has a rounded, convex ridge 136 that extends along the height of the cover or a significant portion thereof. Ship lap end 103 has a receiver channel 137 with a concave surface that generally corresponds to the convex ridge 136. Bias ridges 138, 139 extend along the surface of the recess 103 on opposite sides of the channel 137. The edges of the bias ridges adjacent the channel extend partially over the channel. When the cover 100 is wrapped around a motor housing, ship lap end 102 overlaps with the ship lap end 103, and the convex ridge 136 presses against the bias ridges 138, 139 and forces them away from the receiver channel 137 so that the convex ridge 136 fits into the receiver channel 137. The body of the cover is resilient and the bias ridges bear against the edges of the convex ridge 136 to keep it in place. The lapped ends of the assembled cover form a narrow seam 115.

Those skilled in the art will understand that the invention may be made with the above ship lapped ends or ridge/groove connections, or any other suitable connection for holding one ship lapped end on another ship lapped end. In operation, the magnets 141 in the pockets 140 support the cover on the fan motor housing and keep the cover on the surface of the housing. The ship lapped connections keep the ends of the cover closed.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A cover for a motor housing of a ceiling fan, the cover comprising:

a flexible wrap for covering a ceiling fan motor housing; and a magnetic assemblage associated with said flexible wrap for attaching said wrap to said motor housing, wherein said magnetic assemblage includes a plurality of magnets and said wrap has a plurality of pockets for holding said plurality of magnets.

2. The cover of claim 1 wherein said wrap comprises two ends and said magnetic assemblage includes magnets situated proximate to the ends.

3. The cover of claim 1 wherein said magnetic assemblage includes magnets distributed along the length of said wrap.

4. The cover of claim 1 further comprising auxiliary means for holding two ends of the cover together.

5. The cover of claim 4 wherein the ends of the cover each define a ship lap end and the auxiliary means comprises means for connecting one ship lap end to the other.

6. The cover of claim 4 wherein the auxiliary means comprises a convex ridge at one end and a receiver channel at the other end, said convex ridge and said receiver channel being sized relative to each other to secure the ends together.

7. The cover of claim 6, the receiver channel comprising a pair of bias ridges disposed on the edges of said receiver channel in order to retain the convex ridge in the receiving channel.

8. The cover of claim 1, wherein the flexible wrap comprises a decorative layer.

9. The cover of claim 1, wherein the flexible wrap comprises an insulation layer.

10. A cover for a motor housing of a ceiling fan, the cover comprising:

a flexible wrap for covering a ceiling fan motor housing, the wrap having a first end and a second end;

a plurality of magnets each disposed in a pocket in said wrap for attaching said wrap to said motor housing; and a ship lap end defined by each of the first end and the second end.

11. The cover of claim 10 wherein said ship lap end of the first end comprises a convex ridge and said ship lap end of the second end comprises a receiver channel, said convex ridge and said receiver channel being sized relative to each other to secure the ends together.

12. The cover of claim 11, the receiver channel comprising a pair of bias ridges disposed on the edges of said receiver channel in order to retain the convex ridge in the receiving channel.

13. The cover of claim 10, wherein the flexible wrap comprises a decorative layer.

14. The cover of claim 10, wherein the flexible wrap comprises an insulation layer.

15. A cover for a motor housing of a ceiling fan, the cover comprising:

a flexible wrap for covering a ceiling fan motor housing, wherein the ends of the flexible wrap define a ship lap ends;

a magnetic assemblage associated with said flexible wrap for attaching said wrap to said motor housing, wherein said magnetic assemblage includes magnetic particles distributed about a region of said wrap; and auxiliary means for connecting one ship lap end to the other.

16. The cover of claim 15 wherein the auxiliary means comprises a convex ridge at one end and a receiver channel at the other end, said convex ridge and said receiver channel being sized relative to each other to secure the ends together.

17. The cover of claim 16, the receiver channel comprising a pair of bias ridges disposed on the edges of said receiver channel in order to retain the convex ridge in the receiving channel.

* * * * *